US006164758A

United States Patent [19]

Kretschmer

[11] Patent Number: 6,164,758

[45] Date of Patent: Dec. 26, 2000

[54] RE-CODING OF INK PRINT HEADS

[75] Inventor: Joachim Kretschmer, Rüti, Switzerland

[73] Assignee: Pelikan Produktions AG, Switzerland

[21] Appl. No.: 09/199,589

[22] Filed: Nov. 25, 1998

[30] Foreign Application Priority Data

Nov. 28, 1997 [GB] United Kingdom ..... 197 52 938

[51] Int. Cl.[7] ..... B41J 3/51

[52] U.S. Cl. ..... 347/50; 347/19

[58] Field of Search ..... 347/19, 50, 49, 347/199; 400/174, 175

[56] References Cited

U.S. PATENT DOCUMENTS 4,396,923 8/1983 Noda ..... 347/191
4,554,559 11/1985 Heath ..... 347/199
4,872,027 10/1989 Buskirk et al. ..... 347/49
4,930,915 6/1990 Kikuchi et al. ..... 400/175
5,831,649 11/1998 Watrobski et al. ..... 347/19

*Primary Examiner*—N. Le
*Assistant Examiner*—Anh T. N. Vo
*Attorney, Agent, or Firm*—Fay, Sharpe, Fagan, Minnich & McKee LLP

[57] ABSTRACT

Process for re-coding of print heads equipped with electronic codings, whereby the coding of an original print head A is altered in such manner that it is identical to that of another print head B. This is attained by interruption of conductive connections between contacts and the placement of new conductive connections between contacts of the print head A in accordance with the conductive connections of print head B. The re-coding can be designed in reversible as well as irreversible form.

13 Claims, 4 Drawing Sheets

BC-20

BC-21

BC-22

BC-20

BC-21

BC-22

RE-CODING OF INK PRINT HEADS

The present invention concerns a process for re-coding of print heads which have an electronic coding.

Print heads which are equipped with an electronic coding are known in the state of the art. These involve exchangeable print heads which can be installed in and removed from the ink printer by the end user. More and more ink printers can be equipped with exchangeable print heads of this type. Thus, the trend is away from the formerly traditional permanent print heads, which were firmly installed in the printer and which could only be removed by service personnel. Exchangeable print heads are frequently produced as so-called disposable print heads, whose entire ink reservoir is integrated into the print head. If the ink reservoir in the print head is used up, the entire print head is replaced.

Such exchange systems make it possible to employ within one printer different types of print heads. Printer drivers offer optimized settings for the respective print heads. In order to attain optimum print quality it is a prerequisite that the correct head is employed for the correct setting. This may be left up to the user or by automation via electronic recognition of the print head. In case of the latter, the print driver alerts the user if a wrong print head/driver setting has been selected. To that end, the print head must be equipped with an electronic coding.

The coding indicates, for example, to the driver which type of print head is currently in the printer, for example, a monochromatic or a color cartridge. In addition, with the aid of such electronic coding, numerous other functions are also made available. For example, with ink printers, the important cleaning and covering station components of the printer. That component ensures that print quality will remain good and will not change during the entire ink filling. Some printers employ for said purpose a pure covering function, i.e. the jets are covered as long as they are not in operation, others have, additionally, a cleaning and suctioning function, so that it is possible to wipe across the jet plate, to dab same or to suction ink through the head. With these functions there is direct contact between print head, ink and covering station. Therefore, it is not possible to employ the same station for color and monochromatic print head, since that would result in loss of quality. Coding of the print head permits switching between different covering stations. Examples of codings are cited in JP-08-58-082 and DE-OS 21 14 360.

Coding is also necessary in order to prevent installation of the wrong print head. Otherwise a head, which might fit mechanically into the printer, but requires a different supply tension or terminal frequency than provided by the printer, could become damaged.

Electronic coding is also employed if various print heads offer different possibilities, such as, for example, physical ink recognition, ability of refilling via exchangeable ink reservoirs, etc. By means of the electronic coding, the printer recognizes the special properties of the installed print head type.

Despite these and other benefits offered by an electronic coding on the print head, preventing the use of different types of print heads may be a disadvantage, inasmuch as in many instances an ecologically beneficial and for the user economically sensible conversion of such print heads is made more difficult thereby. Such ecologically and economically sensible conversion is, for example, equipping the print head with exchangeable ink reservoirs. For some of the print heads, this is a lot more costing than with others because of the differences in their construction.

It is the object of the present invention to provide a process which avoids expensive conversion of a print head having a certain, inside a coding stored property profile, whereby, at the same time, a print head is made available which has the properties aimed at by the conversion.

Said object is solved according to the invention by means of a process according to claim 1. Accordingly, the process according to the invention is characterized in that the coding of an original print head A is changed in such manner, that it is identical with that of another print head B, whereby said re-coding comprises the interruption of conductive connections between contacts and the placement of new conductive connections between contacts of print head A in accordance with the conductive connections of print head B. In addition, a print head, according to claim 13 is an integral part of the solution of the above object.

If, for example, a conversion is to be made for any kind of print head B, for example fitting with an exchangeable ink cartridge, but is such conversion can be effected only with difficulty, then, instead of said conversion another print head A, which has a different property profile from print head B in its coding memory, and which, in addition, already incorporates the properties targeted by the conversion, can be re-coded in such manner that its coding corresponds to the coding of print head B.

An example for this is a case where print head A is equipped with exchangeable ink reservoirs, but it involves a standard color print head which has the corresponding coding, and print head B is a color print head for photo prints, whose ink reservoir, however, cannot be exchanged. Instead of converting print head B in such manner that it can be equipped with exchangeable ink reservoirs, which, under certain circumstances, might require a very costly procedure, the coding of print head A, according to the invention, can be changed in such manner that it is identical with the coding of print head B, so that the printer driver recognizes that the print head A is now supplied with photo ink.

Thus, by means of a relatively simple process, print heads can be refilled which were originally designed as disposable items. This makes sense, particularly ecologically, since clearly less waste is produced, because only the refill container needs to be disposed of and not the entire print head. The process however is also of significance economically, inasmuch as the print head constitutes the technologically more valuable component, which is produced at high cost. As a result of multiple employability, important resources are thus saved, which are being wasted with respect to disposable print heads.

The process according to the invention is also suitable—if a conversion needs to be done on a print head as a result of which the converted print head, in its essential properties, is more like another print head type than its "original type"—to render recognizable, by means of the re-coding, said new property profile to the printer driver. The process can be employed for both, producer-internal re-codings as well as producer-external re-codings.

Laying new connections can be done by application of a conductive varnish via screen or tampon print by gluing a foil equipped with a conductor onto the contact conductor plate of the original print head. There is also the possibility of using welded connections between corresponding terminals and/or similar processes. If the codings of the two print heads differ by having conductor lines with different resistors, then an appropriate resistor can be inserted into the appropriate conductive connection of the original print head. This is possible, for example, by means of a suitable conductor line guide. The interruption of conducting connections can be effected, for example, mechanically by severing the conductive lines via drilling or cutting. In addition, there exists the possibility of imprinting of non-conductive varnish or gluing of a non-conducting foil as well as other measures known on its own, having the same effect. The described measures can be performed quickly and without much expenditure in time and material. The re-coding is done "irreversibly", i.e. it is intended, in essence, that it will not be reversed for the entire service life of the print head.

In addition, however, there also exists the possibility to design a so-called "multi-function print head". For this purpose, the re-coding can be designed "reversible" i.e. the print head is not permanently converted, but the coding is designed as being "changeable". This can be done, for example, that between the contact plate and the chip of the original print head a thin isolating plate is inserted, which is equipped with openings at those places where a conductive connection is provided and which covers, in insulating manner, the remaining contacts. If the re-coding is to be reversed, then it is only necessary to again remove the insulating plate.

Another possibility of reversible re-coding can be realized with an anisotropically conductive contact plate. Said contact plate has the property that it is electrically conductive in the direction of its thickness, whereas vertically there exists no conductivity at all. Such behavior can, for example, be caused with rubber-like materials, into which conductive threads are worked, which are aligned in thickness direction. These threads facilitate conductivity in thickness direction, but are, within the area, geometrically separated from each other, so that normally no electrical conductivity exists relative to the direction of the thickness. Such behavior can also be produced with a rubber mass if iron powder is magnetically oriented in the mass before the material hardens. In case of re-coding via an anisotropically conductive contact plate, said plate is punched out at those locations where there is to be no electrical contact.

The possibility also exists to switch back and forth between the codings with a switch. It has already been stated that an existing through contact can be destroyed by a bore hole. Subsequently, conductor lines can then again be printed and passed to a switch. This affords the possibility of changing back and forth between two codings.

These so-called multi-function print heads can, for example, be fitted with both a color and also a monochromatic cartridge or with cartridges containing specialty inks, for example, photo or neon ink.

The present invention is now explained in more detail on the basis of a preferred exemplary embodiment making reference to the attached pages of figures.

FIGS. 1*a–c* depict a schematic representation of the different codings of three different print heads of the BC-2X series by Canon;

FIG. 2 depicts the contact numeration of these print heads;

FIG. 3*a* depicts a detailed view of a conductive contact;

FIG. 3*b* depicts a view of the same contact after it was isolated by means of covering;

FIG. 3*c* depicts a view of the contact of FIG. 3*a*, where the conductive connection has been interrupted by means of milling away the contact;

FIG. 3*d* depicts a view of the contact of FIG. 3*a*, where the conductive connection was destroyed by drilling;

Figure 1:
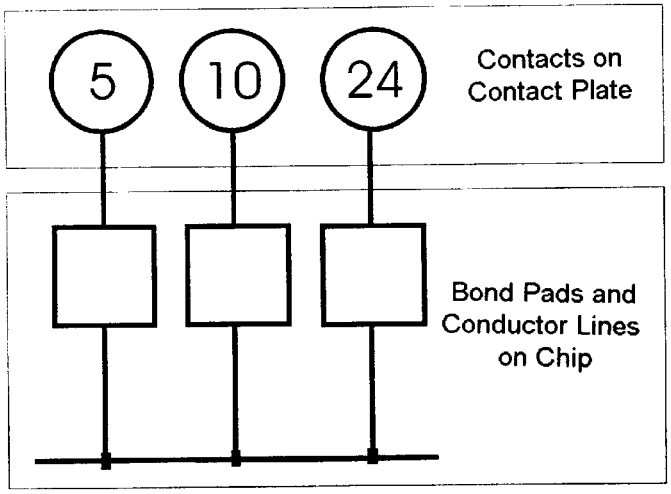
Figure 1:
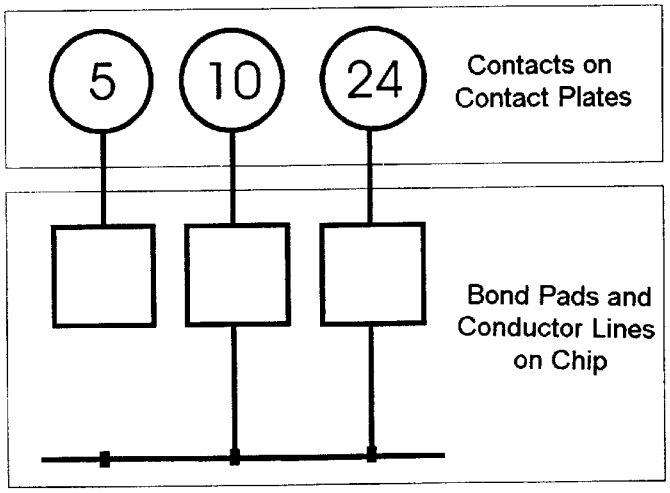
Figure 1:
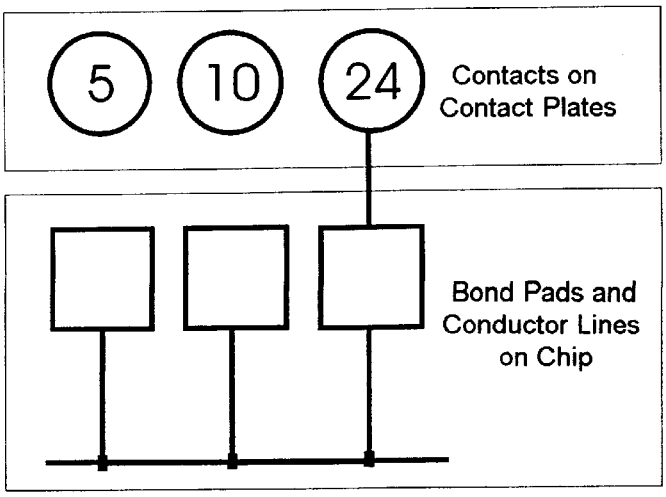

FIGS. 1*a*–1*c* depicts schematically the difference between the electronic codings of three print heads from the BC-2X series of the Canon Company, which are employed for use in the Canon BJC4200 printers. Involved are the print head BC20, a monochromatic disposable cartridge with 128 jets, the print head BC-21 with replaceable ink reservoirs and a total of 136 jets, the print head BC-22 for photo print-outs and the print head BC-29F for neon color (not shown) with 136 jets each. Each of the print heads is recognized by the printer.

If one wants to convert the BC-22 with photo ink reservoir in such manner that it can be refilled several times, there are basically two different ways. First, a conversion of said print head can be undertaken in order to realize the benefit of refill-capability also with respect to the originally disposable unit designed cartridge. The original mono-block print head is mechanically changed in such a manner into an adapter that it can be refilled with an ink reservoir—the so called "Click"—but it will nevertheless continue to fit in the printer. This is, however, very expensive with respect to the BC-22, since the print head must be totally re-worked and, in addition, an appropriate refill container must be constructed. The second possibility consists in developing the Click-System on the basis of the BC-21 print head. This has the advantage that the basic print head involves already a ClickSystem and therefore the print head need not be changed mechanically. An additional re-coding according to the invention is then needed, since otherwise the printer would recognize the BC-21 as BC-21 and would not allow the settings in the printer driver needed for photo print.

Figure 2:
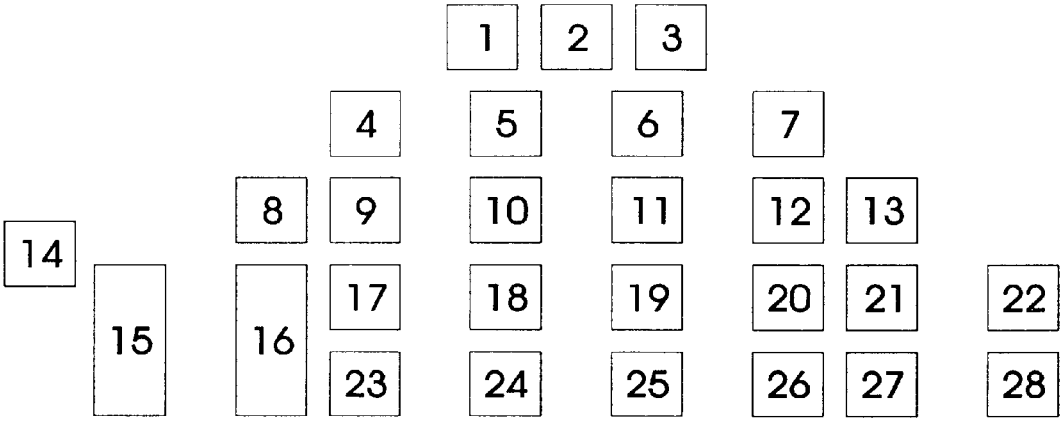

In the BC-2X cartridges, the following are used by way of electronic codings: interrupted conductor lines, conductor line bridges in the chip, different conductor line guides on the contact plate and different chip bond patterns. Numeration of the contacts is schematically shown in FIG. 2.

Figure 3:
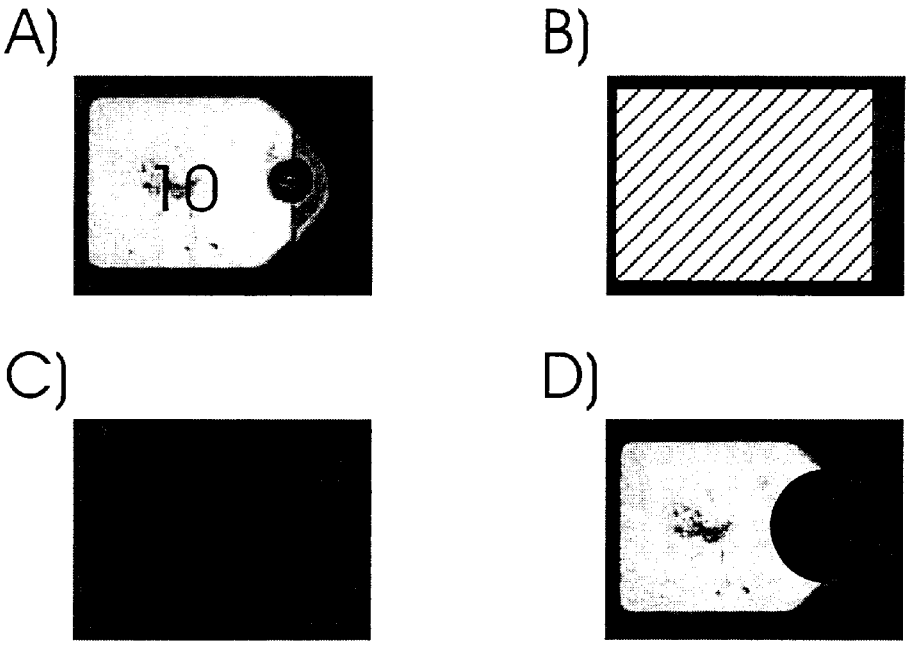
Figure 4:
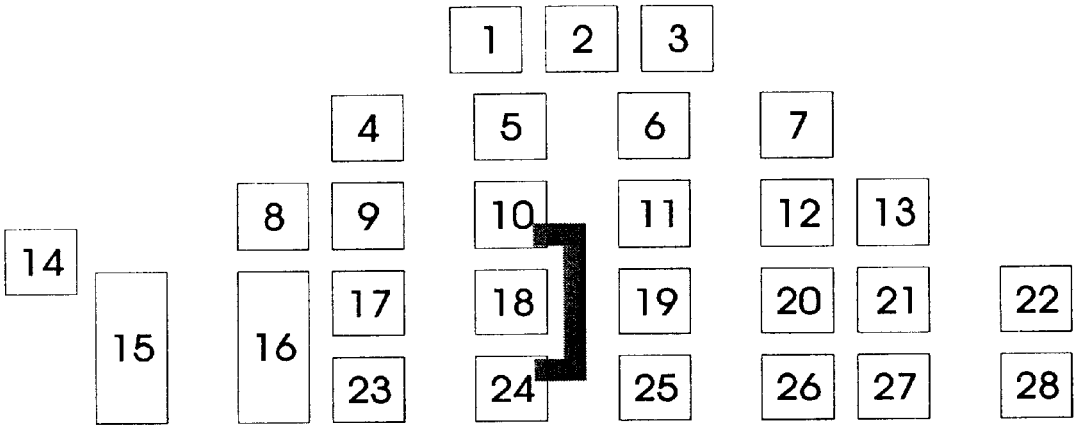
FIG. 4 depicts a view similar to that of FIG. 2, whereby a new conductive connection was established between two contacts.

The electronic difference between BC-21 and BC-22 consists in the connection of the contacts 5, 10 and 24 (FIG. 1*a*–1*c*). With BC-21 the contacts 10 and 24 are electrically connected, but in the case of the BC-22, they are not. If the BC-21 print head is not to appear to the printer electronically as BC-22, then with respect to BC-21, contact 10 must be electrically isolated. There are different possibilities to achieve that. The initial contact 10 (FIG. 3*a*) can, for example, be overprinted by mean of insulating varnish, i.e. permanently covered (FIG. 3*b*). In addition, the contact can also be removed by milling (FIG. 3*c*), or by destroying the through connection point to the lower conductor line plane by means of a bore hole (FIG. 3*d*).

If it is beneficial to re-code the BC-22 into the BC-21, then an electrical connection must be made from contact 10 to contact 24. There are also several methods for doing this. For example, conductive varnish can be printed onto the contact conductor plate via screen or tampon print (FIG. 5), or a foil with conductor line can be glued on. A thin welded connection is also conceivable. With all these methods, attention must be paid that the application thickness on the conduction plate will not prevent the other electrical contacts from making contact.

The re-coding also affords the possibility of developing a multi-function print head. That means that the print head is not permanently converted, but that the coding is designed changeably. The starting point may be, for example, the BC-21 print head with exchangeable ink reservoirs. In the original print head, reservoirs are built in with standard color ink. Based on the electronic coding, this head is suitable only for this ink. By means of an electronic re-coding, the possibility, however, is opened up to expand the application range of the print head to include photo ink or neon ink. This brings with it significant ecological as well as financial benefits. Below we are indicating some possibilities as to how the reversible re-coding can be designed.

Figure 5:
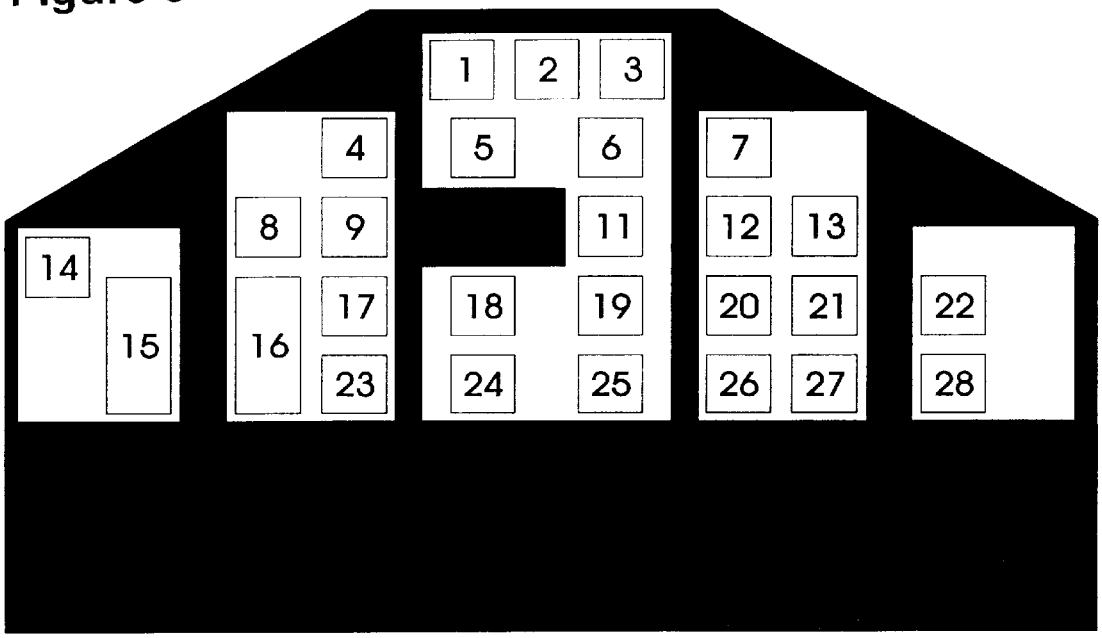
FIG. 5 depicts a figure similar to FIG. 2, whereby one contact was electrically isolated by means of covering; and, FIG. 6 depicts a schematic representation of an anisotropically conductive plate.

If the BC-21 print head is used with standard color ink, it can be employed without electronic change. If, however, photos are to be printed, then the Clicks with photo ink must be inserted. For the necessary electronic re-coding, a thin insulating plate is then installed, which leaves open all electronic contacts of the print head and which overs only contact 10 (FIG. 5). The electronics of the printer no longer "sees" the connection between contacts 10 and 24 and recognizes the head as BC-22. If subsequently the print head is to be used once more with standard color ink, then the re-coding must be reversed and the clicks must be exchanged. The ink which remained in the print head during the change is automatically suctioned off during insertion into the printer. An additional suctioning step may have to be performed in order to maintain optimal print quality.

Figure 6:
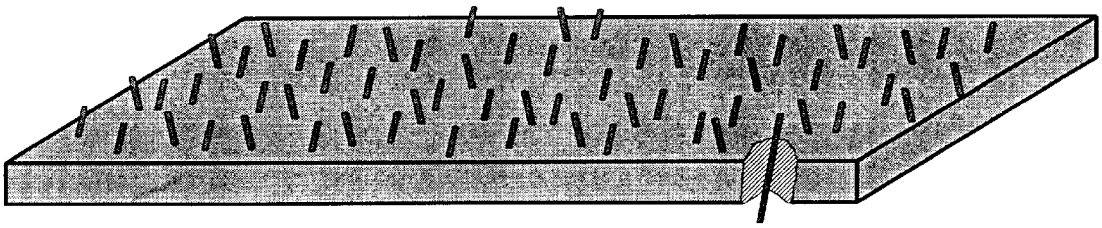

Another possibility of reversible re-coding can be realized by insertion of an anisotropically conductive contact plate. A schematic representation of such a plate is shown in FIG. 6. The plate 1 consists of an electrically insulating material, into which are worked conductive threads 3, extending vertically to the plane of the plate. In order to re-code, for example, BC-21 so that its coding corresponds to the coding of the BC-22 it is necessary that in such anisotropically conductive contact plate a portion of the contact rubber is punched out at the geometric location of contact 10, so that the electrical connection is severed.

As already mentioned, there also exists the possibility of changing between the codings by means of a switch. In the case of BC-21, the through contact of contact 10 can be destroyed, for example, by a bore hole. Subsequently it is then necessary to print new conductor lines to the contacts 10 and 24 and conduct to a switch. This affords the possibility to switch back and forth between the BC-21 coding and the BC-22 coding. A multi-function cartridge or a multi-function print head can for example also be realized with the BC-22 print head. In that case, the print head must be converted to the Click. In addition, a reversible electrical connection between the contacts 10 and 24 is necessary. This can be realized by a thin electrical connection plate, which is flexible in the ideal case, so as to simplify the contacting. In that case, attention must be paid to precise positioning, so that no other electrical connections are changed.

The re-coding examples which were pointed out here are by no means limited to same. The process is applicable to other print heads as well, for example to print heads by Lexmark, Olivetti and various other producers. With respect to Olivetti, there exists for example the possibility to re-trace the print head contacts of this print head in comparison with the HP print heads by printed conductor lines.

Based on the use of the process described in the preceding, there exists a diversity of possibilities to employ print heads in various ways. The decisive factor should be the individual estimates with regard to expenditure and cost.

I claim:

1. Process for re-coding of print heads equipped with electronic codings, characterized in that a coding of an original print head (A) is changed in such a manner that it is identical with that of another print head (B) by determining the electronical difference between the coding of the original print head (A) and the other print head (B) and eliminating that difference by interruption of conducting connections between contacts and by placement of new conducting connections between contacts of the print head (A) in accordance with the conduction connections of the print head (B).

2. Process according to claim 1, characterized in that the placement of new conducting connections is done by application of conductive varnish onto a contact conducting plate of print head (A) by means of screen or tampon print.

3. Process according to claim 1, characterized in that the placement of new conducting connections is done by gluing a foil equipped with a conductor line onto a contact conductor plate of the print head (A).

4. Process according to claim 1, characterized in that the placement of new conducting connections is done by establishing a welding connection between the contacts.

5. Process according to claim 1, characterized in that the placement of new conducting connectors comprises an installation of electrical resistors between contacts.

6. Process according to claim 1, characterized in that the interruption of conducting connections is done mechanically.

7. Process according to claim 6, characterized in that the interruption of conducting connections is done by severing conductor lines by means of drilling or cutting.

8. Process according to claim 1, characterized in that the interruption of conducting connections is done by imprinting non-conducting varnish or by gluing a non-conducting foil.

9. Process according to claim 1, characterized in that the interruption of conduction connections and the placement of new conducting connections is done reversibly.

10. Process according to claim 9, characterized in that between contact plate and chip of the print head (A) a thin insulating plate is inserted, which has openings at those locations where a conductive connection is provided.

11. Process according to claim 9, characterized in that between contact plate and chip of print head (A) an anisotropically conductive contact plate is inserted, which has recesses at those locations where no electrical contact is supposed to exist.

12. Process according to claim 9, characterized in that the interruption of conducting connections and the placement of new conducting connections is done in such manner that switching between the coding of the original print head (A) and the coding of print head (B) is made possible by means of a switch.

13. Print head for ink printer which is equipped with an electrical coding, which was altered, in accordance with a process of claim 1.

* * * * *

UNITED STATES PATENT AND TRADEMARK OFFICE

CERTIFICATE OF CORRECTION

PATENT NO. : 6,164,758
DATED : December 26, 2000
INVENTOR(S) : Joachim Kretschmer It is certified that error appears in the above-identified patent and that said Letters Patent is hereby corrected as shown below:

Title page,
Item [30], Foreign Application Priority Data, replace "(GB) United Kingdom" with -- (DE) Germany --.

Signed and Sealed this

Twenty-sixth Day of July, 2005

JON W. DUDAS
*Director of the United States Patent and Trademark Office*